United States Patent [19]

Grüllmeier

[11] 4,300,351

[45] Nov. 17, 1981

[54] BOOSTED HYDRO-PNEUMATIC DRIVE

[75] Inventor: Artur Grüllmeier, Salem, Fed. Rep. of Germany

[73] Assignees: Eugen Rapp; Paul Haug, both of Fed. Rep. of Germany

[21] Appl. No.: 179,296

[22] PCT Filed: Apr. 21, 1979

[86] PCT No.: PCT/EP79/00027

§ 371 Date: Dec. 26, 1979

§ 102(e) Date: Dec. 20, 1979

[87] PCT Pub. No.: WO79/00986

PCT Pub. Date: Nov. 29, 1979

[30] Foreign Application Priority Data

Apr. 26, 1978 [DE] Fed. Rep. of Germany ..... 2818337

[51] Int. Cl.[3] ..... F15B 7/00; F15B 15/18

[52] U.S. Cl. ..... 60/560; 60/563; 60/565; 60/593

[58] Field of Search ..... 60/560, 563, 564, 574, 60/576, 586, 593, 565; 91/519

[56] References Cited

U.S. PATENT DOCUMENTS

| | | | |
|---|---|---|---|
| 2,827,766 | 3/1958 | Hufferd | 60/560 |
| 3,426,530 | 2/1969 | Georgelin | 60/560 |
| 4,072,013 | 2/1978 | Barbareschi | 60/560 |

FOREIGN PATENT DOCUMENTS

| | | | |
|---|---|---|---|
| 2017007 | 10/1971 | Fed. Rep. of Germany | 60/593 |
| 2304752 | 8/1974 | Fed. Rep. of Germany | 60/560 |
| 560678 | 4/1944 | United Kingdom | 60/593 |

*Primary Examiner*—Abraham Hershkovitz

[57] ABSTRACT

In a boosted hydro-pneumatic drive for rapid traverse and power stroke, particularly for driving punching tools, a cylinder housing (1, 4) with partition (12), a disc piston (7) with plunger (8), a working piston (2) which can be loaded with compressed air for the return stroke and an annular piston (9) surrounding the plunger (8) are provided. The cylinder spaces between the working piston (2) and the annular piston (9) on both sides of the partition (12) are filled with hydraulic oil.

In order to reduce the consumption of compressed air and to increase the speed of response, and for the purpose of simplification, the working piston (2) is provided with an annular surface (**16*a*) which can be loaded with compressed air in the direction of advance, and a compression spring (10) is clamped between the disc piston (7) and the annular piston (9). The space accommodating the compression spring (10) is in constant connection with the outside air, preferably via a filter (11**).

3 Claims, 1 Drawing Figure

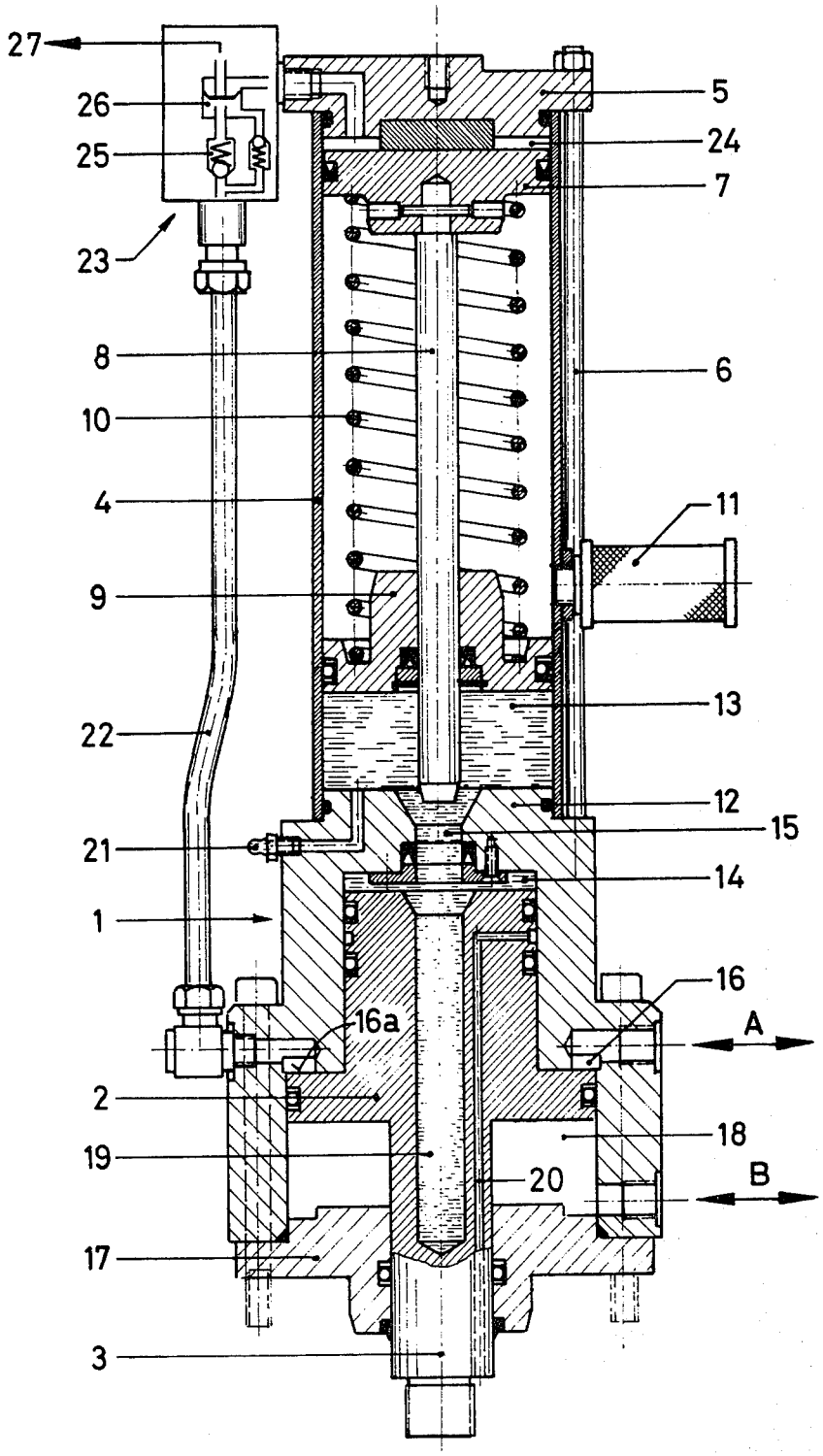
27
26
25
23
8
10
4
9
22
21
1
2
19
17
3
5
24
7
6
11
13
12
15
14
16
16a
A
18
20
B

BOOSTED HYDRO-PNEUMATIC DRIVE

BACKGROUND OF THE INVENTION

The invention relates to a boosted hydro-pneumatic drive for the rapid-traverse and power stroke modes, particularly for driving punching tools, consisting of a cylinder housing with partition, a disc piston with plunger, a working piston which can be loaded with compressed air for the return stroke, and an annular piston surrounding the plunger. The cylinder spaces between the working piston and the annular piston on both sides of the partition are filled with hydraulic oil.

Underlying state of the art is evidenced by U.S. Pat. No. 3,426,530 and U.S. Pat. No. 4,072,013.

In a drive of this class, known from U.S. Pat. No. 3,426,530, during rapid traverse compressed air is introduced into the space between the annular piston and the disc piston. The annular piston thereby displaces the supply of hydraulic oil and with the aid of the latter moves the working piston. The aforementioned space is simultaneously the space swept by the disc piston during the power stroke, and in rapid traverse forms a dead air space which is relatively large. This has the disadvantageous consequence that a great amount of compressed drive air is consumed during rapid traverse. In addition, the build-up and reduction in pressure requires a relatively long time in this large space, reducing the speed of response of this known drive. At the same time it must be considered that the drive air pressure of the rapid traverse must be removed completely for the power stroke since it opposes the starting movement of the disc piston.

Since the annular piston of the known drive is loaded on one side with compressed air and on the other side with hydraulic oil, it is provided with a special sealing arrangement consisting of two sealing rings and ventilation of the annular space between them. From experience, this is unavoidable since no seal is completely tight for long and since, therefore, air could get into the hydraulic oil and cause it to foam without ventilation of the interspace. The consequence of this would be that the required power could not be generated at the working piston and the drive could heat up to an inadmissible degree. Since, however, the ventilating opening in the cylinder housing does not move with the annular piston, the sealing rings must be spaced apart by at least the length of the stroke of this piston. This brings about a disadvantageous extension of the whole cylinder housing of the drive according to U.S. Pat. No. 3,426,530.

Finally, the construction of this known drive is of a complicated type in that the plunger is a hollow body into which projects a trunk-shaped projection of the front wall of the cylinder.

A boosted hydro-pneumatic drive of a different class is known from U.S. Pat. No. 4,072,013. In order to move the working piston in a rapid traverse, it is provided with an annular surface which can be loaded with compressed air in the direction of advance. Although this reduces the response time, a lot of compressed drive air is consumed by this known arrangement since an additional annular piston, surrounding the working piston and supported in its own cylinder housing, is loaded with compressed air. Furthermore, the concentric nesting structure of this known drive has essential disadvantages related to production engineering, which can also be seen from the great number of components required.

The present invention consists in a boosted hydro-pneumatic drive as follows the working piston is provided with an annular surface which can be loaded with compressed air in the direction of advance, a compression spring is clamped between the disc piston and the annular piston and the space containing the compression spring is always connected to the atmosphere.

Such a drive consumes little compressed drive air per stroke, responds quickly, is of short constructional length and is easy to produce.

A considerable reduction in the consumption of compressed air is the result, on the one hand, of the elimination of all dead air space and, on the other hand, of the fact that the annular piston is no longer driven by means of compressed air but by means of the compression spring. Simultaneously there is an increase in the speed of response, that is to say a shortening of the time interval from the start signal to the end of the power stroke, an advantageous contributing factor to this being the compressing spring since the initial pressure effected by it in the oil reservoir supports the pneumatic drive of the working piston in a rapid traverse. The hitherto required dual sealing of the annular piston can be omitted since this is no longer loaded with compressed air. Rather, as mentioned, the hydraulic oil is under constant excess pressure, so that, at the most, oil can leak out but air can never get into the oil. Due to the elimination of the spaced dual sealing, the annular piston and thus the whole cylinder housing can be shortened considerably. Finally, the invention achieves a structural simplification by the elimination of both tubular and multiple concentrically nested elements, producing a noticeable advantage in production and thus in price.

Since the space containing the compression spring reduces its volume with every working stroke and increases it again, air is ejected and sucked in again from the environment. This breathing process produces an advantageous cooling of the drive. In order to keep the resistance to air flow low and to prevent dust and foreign bodies from entering into the space, it is proposed in further development of the invention that the connection to the atmosphere is made via a filter.

BRIEF DESCRIPTION OF THE DRAWING

The drawing represents a longitudinal section of a boosted hydro-pneumatic drive with a working piston constructed as a stepped piston.

The arrangement shown is composed of a high-pressure cylinder 1, in which a stepped working piston 2 with a piston rod 3 can move, and a compressed air cylinder 4, the cover 5 of which is clamped to the high-pressure cylinder 1 with the aid of several long tightening screws 6 distributed about its periphery. the compressed air cylinder 4 contains a disc piston 7 which is firmly connected to a plunger 8, and an annular piston 9 which is sealed on its inside with respect to the plunger and on its outside with respect to the compressed air cylinder 4. Between the annular piston 9 and the disc piston 7 a compression spring 10 is clamped. The part of the inner space of the compressed air cylinder containing this compression spring 10 is connected to the outside air via a filter 11. The space between the annular piston 9 and the upper partition 12 of the high-pressure cylinder is designated as the oil reservoir 13, and the space between the working piston 2 and this partition is designated as the oil chamber 14. Both are filled with hydraulic oil. In the partition 12 there is a passage 15, extending upwards in the shape of a funnel, with a sealing ring and this can be closed tight by the plunger 8 going downwards.

The high-pressure cylinder 1 has two compressed air connections A and B. The connection A is connected to the annular space 16 formed by the step, making it possible to load an annular surface 16*a* of the working piston 2. The other compressed air connection B leads to the space 18 formed between the working piston 2 and a lower cover 17 of the high-pressure cylinder. The working piston 2 is provided with a central bore 19, open towards the top for receiving the plunger 8, the diameter of this bore being clearly greater than the outer diameter of the plunger 8.

Any leakage of the media air and oil, possibly occurring after prolonged operation, is carried away to the outside via an annular groove and a longitudinal bore 20 in the working piston 2 and its piston rod 3. The hydraulic oil in the oil reservoir 13 can be replenished at any time via a nipple 21 mounted on the high-pressure cylinder 1.

The annular space 16 is connected via a connecting line 22 and a valve unit 23 to the space 24 between the disc piston 7 and the cover 5 of the compressed air cylinder. The valve unit contains a pressure relief valve 25, shown only diagrammatically and opening upwards. In addition, the valve unit contains a rapid release valve 26 which makes the connection between the connecting line 22 and the space 24 if there is pressure in the connecting line 22 and the pressure relief valve 25 is opening and which. On the other hand, valve 26 makes it possible to ventilate the space 24 via an outlet 27 with a drop in pressure in the connecting line 22. The rapid release valve 26 contains a platelet which can be moved up and down, with a lip-like sealing edge. Accordingly during the return of the disc piston this platelet can move downwards and a non-return valve connected as a by-pass in parallel with the pressure relief valve 25 carries the air retained between the pressure relief valve 25 and the platelet into the annular space 16 which in this phase is open towards the outside.

The drive described functions as follows: In the rest positon shown the lower compressed air connection B is charged with compressed air. The working piston 2, therefore, is in its upper position. Similarly, the disc piston 7 is held in its upper position by the compression spring 10.

For the rapid traverse the upper compressed air connection A and thus the annular surface 16*a* is loaded while the space 18 is ventilated. This causes the working piston 2 to move downwards. At the same time the annular piston 9 pushes hydraulic oil from the oil reservoir 13 through the open passage 15 into the oil chamber 14 under the action of the compression spring 10. This hydraulic oil also presses on the working piston 2 in the direction of advance.

If now the working piston 2 meets a resistance, a pressure will build up in the annular space 16, which opens the pressure relief valve 25 so that the compressed air moves the disc piston 7 with the plunger 8 downwards against the force of the compression spring 10.

As soon as the plunger 8 moves through the passage 15 and its sealing ring the annular piston 9 will come to a standstill and the hydraulic oil in the oil chamber 14 is displaced by the ingress of the plunger 8 so that a very high pressure arises in the oil chamber and moves the working piston 2 downwards with maximum force for the remainder of its working travel. The force generated corresponds essentially to the ratio of the cross-section of the upper part of the working piston to the cross-section of the plunger times the force exerted on the disc piston by the compressed air. In addition the compressed air still acts on the annular surface 16*a* of the working piston 2 as before.

When the power stroke is completed, the compressed air is switched over again to the connection B and the working piston 2 is pushed back to its starting position. Simultaneously the oil pressure generated above the working piston pushes back the plunger 8, in collaboration with the compression spring 10. The oil finally ejected from the oil chamber 14 is received free of air bubbles by the oil reservoir 13 which is pre-tensioned by the compression spring 10.

The atmospheric air flowing in and out through the filter 11 is not compressed. It contributes considerably to the cooling of the arrangement, particularly in continuous operation.

By way of example only, in the text which follows the most important technical data of a prototype of such a drive are specified: Pneumatic operating pressure 6 bar, rapid traverse force 430 kp, working force 10,000 kp, pull-back force 780 kp, total stroke 30 mm, working stroke 6 mm, number of strokes 40/minute, overall height 500 mm. In view of the high working force, the air consumption of 1.81 of compressed air corresponding to 10.8 l of sucked-in air per stroke, is extremely low. With regard to the application in the press working of metals, where the pull-back force of the working piston must not be too small in relation to the working force, the optimum mutual relationship of the forces must also be pointed out.

The invention is reduced to practice by a certain configuration of a physical object, namely a piston/cylinder arrangement. It can thus be exploited particularly by industrial production, by the sale or use of these objects and by permitting third parties to perform the activities mentioned against a fee.

I claim:

1. Boosted hydro-pneumatic drive having a rapid traverse and a power stroke for driving punching tools comprising a cylinder housing having a first section and a second section separated by a fixed partition;

a working piston slidably mounted in an annular space in said first section, said working piston including a central bore and having an attached piston rod extending out of said housing;

connections provided to said annular space in said first section to selectively apply compressed air pressure to opposite surfaces of said working piston;

said second section having a disc piston and an annular piston slidably mounted therein, said disc piston having a plunger portion extending from one side thereof and adapted to slide into said central bore of said working piston upon application of pressure to the other side of said disc piston, and said annular piston being located at an intermediate position between said disc piston and said partition;

an oil reservoir formed between said annular piston and said partition and having a fluid connection with said central bore;

a compression spring mounted between said disc piston and said annular piston to assist in rapid traverse movement of said working piston and in the return stroke of said disc piston;

said second section having an opening in said housing to the atmosphere and being located to provide atmospheric pressure in said second section throughout the drive cycle;

said second section including a cover portion at the end remote from said partition, said cover and said disc piston having a working space formed therebetween;

means providing a compressed air connection between said working space and that part of said annular space adjacent said partition; and said connecting means including a valve arrangement that is actuable during the power stroke to cause movement of said disc piston whereby said plunger portion slides into said central bore, and is further actuable to allow the return stroke of said disc piston.

2. Boosted hydro-pneumatic drive according to claim 1 wherein said opening in said second section includes a filter unit through which atmospheric air flows in and out during the cycle to cool the drive.

3. Boosted hydro-pneumatic drive according to claim 2 wherein an annular chamber is formed in said oil reservoir adjacent a surface of said working piston, and the oil flows in and out of said chamber during the cycle without being subjected to compressed air.

* * * * *